US006896072B2

(12) United States Patent
MacDonald

(10) Patent No.: US 6,896,072 B2
(45) Date of Patent: May 24, 2005

(54) MULTI-FUNCTIONAL DRILLING VEHICLE

(76) Inventor: Claude MacDonald, 40, Chemin de la MineÉEcole, Val d'Or, Quebec (CA), J9P 7B6

( * ) Notice: Subject to any disclaimer, the term of this patent is extended or adjusted under 35 U.S.C. 154(b) by 0 days.

(21) Appl. No.: 10/807,146

(22) Filed: Mar. 24, 2004

(65) Prior Publication Data

US 2004/0178004 A1 Sep. 16, 2004

Related U.S. Application Data

(63) Continuation of application No. PCT/CA01/01430, filed on Oct. 9, 2001.

(51) Int. Cl.[7] ..... E21B 15/04; E21B 7/02
(52) U.S. Cl. ..... 173/192; 173/189
(58) Field of Search ..... 173/29, 42, 44, 173/39, 174, 175, 189, 37, 192, 193, 218; 175/122, 162

(56) References Cited

U.S. PATENT DOCUMENTS

| | | | | |
|---|---|---|---|---|
| 3,245,180 A | | 4/1966 | Bules et al. | |
| 3,399,734 A | | 9/1968 | Folinsbee | |
| 3,470,969 A | | 10/1969 | Arcangeli | |
| 3,481,409 A | * | 12/1969 | Westerlund | 173/193 |
| 3,500,938 A | * | 3/1970 | Watson | 173/40 |
| 3,576,218 A | * | 4/1971 | Lisenby | 173/28 |
| 3,721,304 A | * | 3/1973 | Hanson | 173/2 |
| 3,784,159 A | | 1/1974 | Skattman et al. | |
| 3,823,902 A | | 7/1974 | Bumueller | |
| 3,917,005 A | | 11/1975 | Cannon et al. | |
| 4,067,398 A | | 1/1978 | Franzen et al. | |
| 4,074,773 A | | 2/1978 | Grigoriev et al. | |
| 4,346,766 A | | 8/1982 | Manten | |
| 4,637,475 A | | 1/1987 | England et al. | |
| 4,645,084 A | * | 2/1987 | Deike | 212/271 |
| 4,799,556 A | * | 1/1989 | Foster et al. | 173/193 |
| 4,915,180 A | * | 4/1990 | Schisler | 173/185 |
| 5,012,873 A | * | 5/1991 | Kennedy et al. | 173/185 |
| 6,152,244 A | * | 11/2000 | Rokbi | 173/184 |
| 6,298,928 B1 | * | 10/2001 | Penchansky | 175/162 |

FOREIGN PATENT DOCUMENTS

DE 27 53 670 6/1979

* cited by examiner

*Primary Examiner*—Rinaldi I. Rada
*Assistant Examiner*—Paul Durand
(74) *Attorney, Agent, or Firm*—P. Martineau

(57) ABSTRACT

The drilling vehicle comprises a chassis movable over ground, a tool arm, a drilling tool operatively mounted to the tool arm and defining a drilling extremity and a selectively powered tool arm actuator assembly attaching the tool arm to the chassis. The tool arm support comprises:

a first tool arm actuator allowing rotational displacement of the tool arm about a vertical axis;

a second tool arm actuator allowing linear translation of the tool arm along a first horizontal axis between two limit positions;

a third tool arm actuator allowing linear translation of the tool arm along a second horizontal axis which is perpendicular to the first horizontal axis, between two limit positions;

a fourth tool arm actuator allowing rotational displacement of the tool arm about a third horizontal axis; and a fifth tool arm actuator allowing pivotal displacement of the tool arm about a fourth horizontal axis which is perpendicular to the third horizontal axis. The position and orientation of the drilling tool drilling extremity is controlled with the first, second, third, fourth and fifth tool arm actuators acting on the tool arm.

19 Claims, 8 Drawing Sheets

MULTI-FUNCTIONAL DRILLING VEHICLE

CROSS-REFERENCE DATA

This is a continuation of international application No. PCT/CA01/01430 filed on Oct. 9, 2001.

FIELD OF THE INVENTION

The present invention relates to drilling vehicles, and more particularly to a multi-functional drilling vehicle for mine shafts.

BACKGROUND OF THE INVENTION

When developing an underground mine, an array of tunnels and corridors have to be made through the rock and soil to reach the ore; these include vertical shafts, inclined tunnels, and horizontal tunnels. In most cases, the mine tunnels or raises have to be blasted through the rock or mineral, with explosive charges. These explosive charges will be installed at the end portion of a hole that is drilled through the rock, to obtain the desired effect.

Explosive charges are also used to extract ore from the integral rock formation. Again, the explosive charges are installed inside a hole that has been drilled into the rock to extract ore from the rock fragments.

Also, metallic cables are installed in the mine corridors, to retain the mine walls and thus help to provide an increased structural integrity of the mine walls. These retaining cables, which may be submitted to important forces and stresses, are installed on the outer free extremity of elongated metallic rods which extend into the rock walls in holes pre-drilled therein.

In all these cases, holes have to be drilled through the solid rock formation in which the mine corridors are made. To drill such holes, drilling buggies equipped with a drilling tool arm used. Known drilling tools include pneumatic or hydraulic drilling tools of known construction.

SUMMARY OF THE INVENTION

The invention relates to a drilling vehicle comprising:

a chassis movable over ground;

a tool arm;

a drilling tool operatively mounted to said tool arm and defining a drilling extremity;

a tool arm actuator assembly attaching said tool arm to said chassis and comprising:

- a first tool arm actuator allowing rotational displacement of said tool arm about a vertical axis;
- a second tool arm actuator allowing linear translation of said tool arm along a first horizontal axis between two limit positions;
- a third tool arm actuator allowing linear translation of said tool arm along a second horizontal axis which is perpendicular to said first horizontal axis, between two limit positions;
- a fourth tool arm actuator allowing rotational displacement of said tool arm about a third horizontal axis; and
- a fifth tool arm actuator allowing pivotal displacement of said tool arm about a fourth horizontal axis which is perpendicular to said third horizontal axis; and selectively controlled power means controlling said first, second, third, fourth and fifth tool arm actuators;

wherein the position and orientation of said drilling tool drilling extremity is controlled with said first, second, third, fourth and fifth tool arm actuators acting on said tool arm.

Preferably, said chassis is modular and comprises at least two chassis portions releasably attached to one another, said tool arm being releasably attached to said tool arm actuator assembly and said tool arm actuator assembly being releasably attached to said chassis.

Preferably, said first tool arm actuator allows said tool to rotate from 0° to 180° relative to a reference position.

Preferably, said first and third horizontal axes are parallel to each other.

Preferably, said fourth tool arm actuator allows said tool arm to rotate from 0° to 360° relative to a reference position.

Preferably, said fifth tool arm actuator allows said tool arm to pivot of at least one quarter of a turn relative to a reference position.

Preferably, said fifth tool arm actuator allows said tool arm to pivot of an angle of 0° to 100° relative to a reference position.

Preferably, said tool arm actuator assembly further comprises an auxiliary tool arm actuator allowing linear translation of said tool arm along said second horizontal axis between two limit positions, independently of said translation of said tool arm resulting from said third tool arm actuator.

Preferably, said first, second, third, fourth and fifth tool arm actuators are sequentially attached to one another and said first tool arm actuator comprises a platform shaft mounted to said chassis so as to be rotatable about said vertical axis.

Preferably, said first, second, third, fourth and fifth tool arm actuators are sequentially attached to one another and said second tool arm actuator comprises a platform integrally attached to said first tool arm actuator and a slider track member having a lower run fixedly attached to said platform and an upper run movably carried by said lower run for allowing translation of said upper run along said first horizontal axis between two limit positions.

Preferably, said second tool arm actuator comprises another slider track member having a lower run fixedly attached to said platform and an upper run movably carried by said lower run for allowing translation of said upper run parallel to said first horizontal axis between two limit positions, said upper run of said another first slider track member being integrally movable with said upper run of the first-mentioned said first slider track member.

Preferably, said first, second, third, fourth and fifth tool arm actuators are sequentially attached to one another and said third tool arm actuator comprises a slider track member having a lower run fixedly attached to said second tool arm actuator and an upper run movably carried by said lower run for allowing translation of said upper run along said first horizontal axis between two limit positions.

Preferably, said first, second, third, fourth and fifth tool arm actuators are sequentially attached to one another and said fourth tool arm actuator comprises a tool shaft rotatably carried by said third tool arm actuator and rotatable about said third horizontal axis.

Preferably, said first, second, third, fourth and fifth tool arm actuators are sequentially attached to one another and said fifth tool arm actuator comprises a pivotable linkage pivotally mounted to said fourth tool arm actuator and carrying a hydraulic cylinder, said linkage and said cylinder also being attached to said tool arm, allowing pivotal displacement of said tool arm about said fourth horizontal axis.

Preferably, said first, second, third, auxiliary, fourth and fifth tool arm actuators are sequentially attached to one another and said auxiliary tool arm actuator comprises a support block movably mounted to said third tool arm actuator by means of a rack and gear assembly, so as to allow said linear translation of said tool arm along said second horizontal axis between two limit positions, independently of said translation of said tool arm resulting from said third tool arm actuator.

Preferably, said drilling vehicle further comprises a control console linked to said selectively controlled power means and controlling said first, second, third fourth and fifth tool arm actuator, said control console being carried by a control arm pivotally mounted to said chassis.

The invention also relates to a drilling vehicle kit comprising:

a modular chassis movable over ground;

a tool arm;

at least one drilling tool operatively attachable to said tool arm and defining a drilling extremity;

a first tool arm actuator assembly, with said tool arm being releasably attachable to said chassis through the instrumentality of said first tool arm actuator assembly which allows said tool arm to be moved according to a first set of directions when said tool arm is operatively mounted to said chassis by means of said first tool arm actuator assembly;

a second tool arm actuator assembly, with said tool arm being releasably attachable to said chassis through the instrumentality of said second tool arm actuator assembly which allows said tool arm to be moved according to a second set of directions when said tool arm is operatively mounted to said chassis by means of said second tool arm actuator assembly; and selectively controlled power means controlling said first and second tool arm actuator assemblies;

wherein either one of said first and second tool arm actuator assemblies may be used to attach said tool arm to said chassis, according to a selected set of directions among said first and second sets of directions, and wherein the position and orientation of said at least one drilling tool drilling extremity is controlled according to said selected set of directions.

DETAILED DESCRIPTION OF THE EMBODIMENTS

Figure 6:
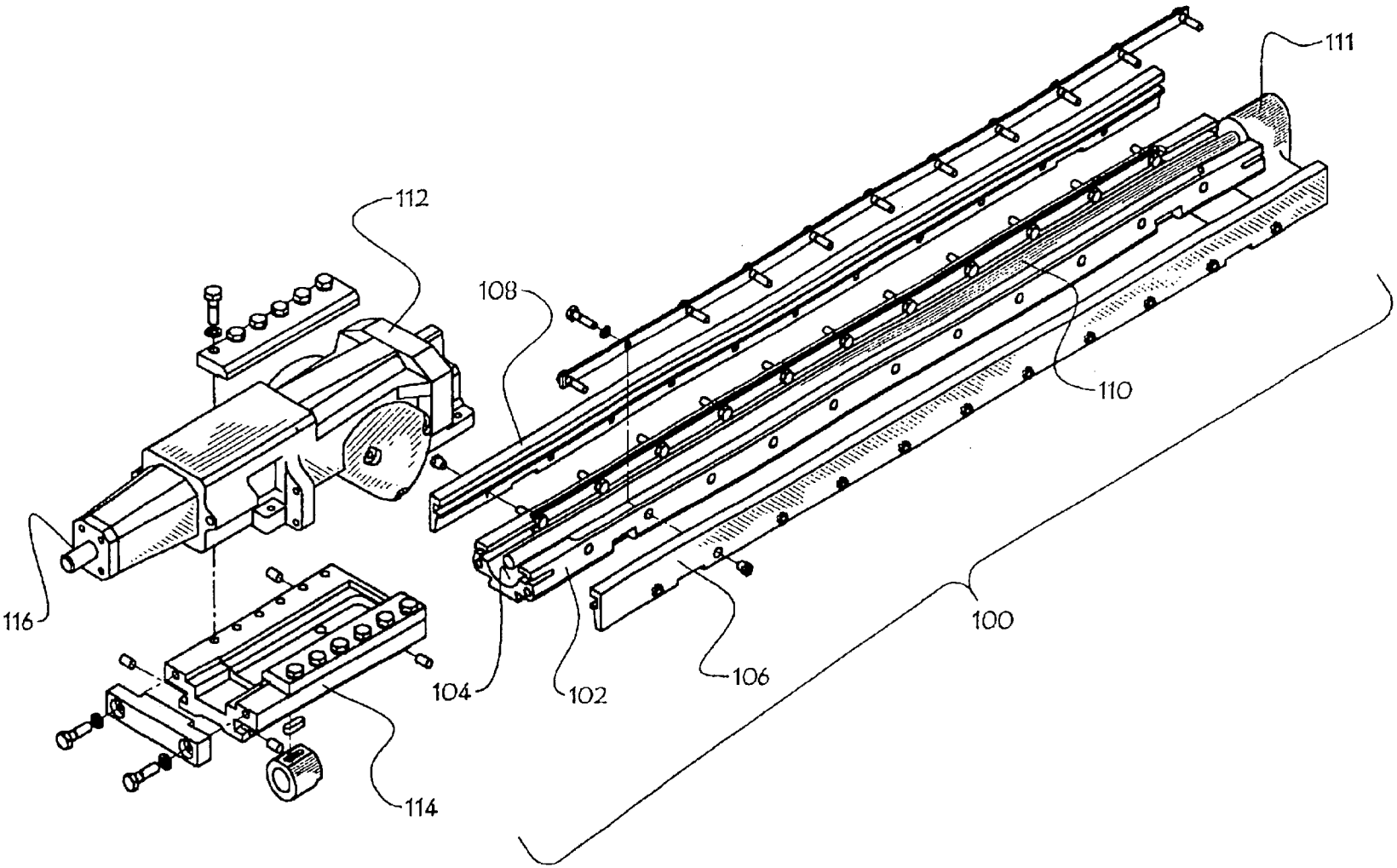
FIG. 6 is an enlarged exploded perspective view of a tool arm and drilling tool embodiment of the vehicle.
Figure 7:
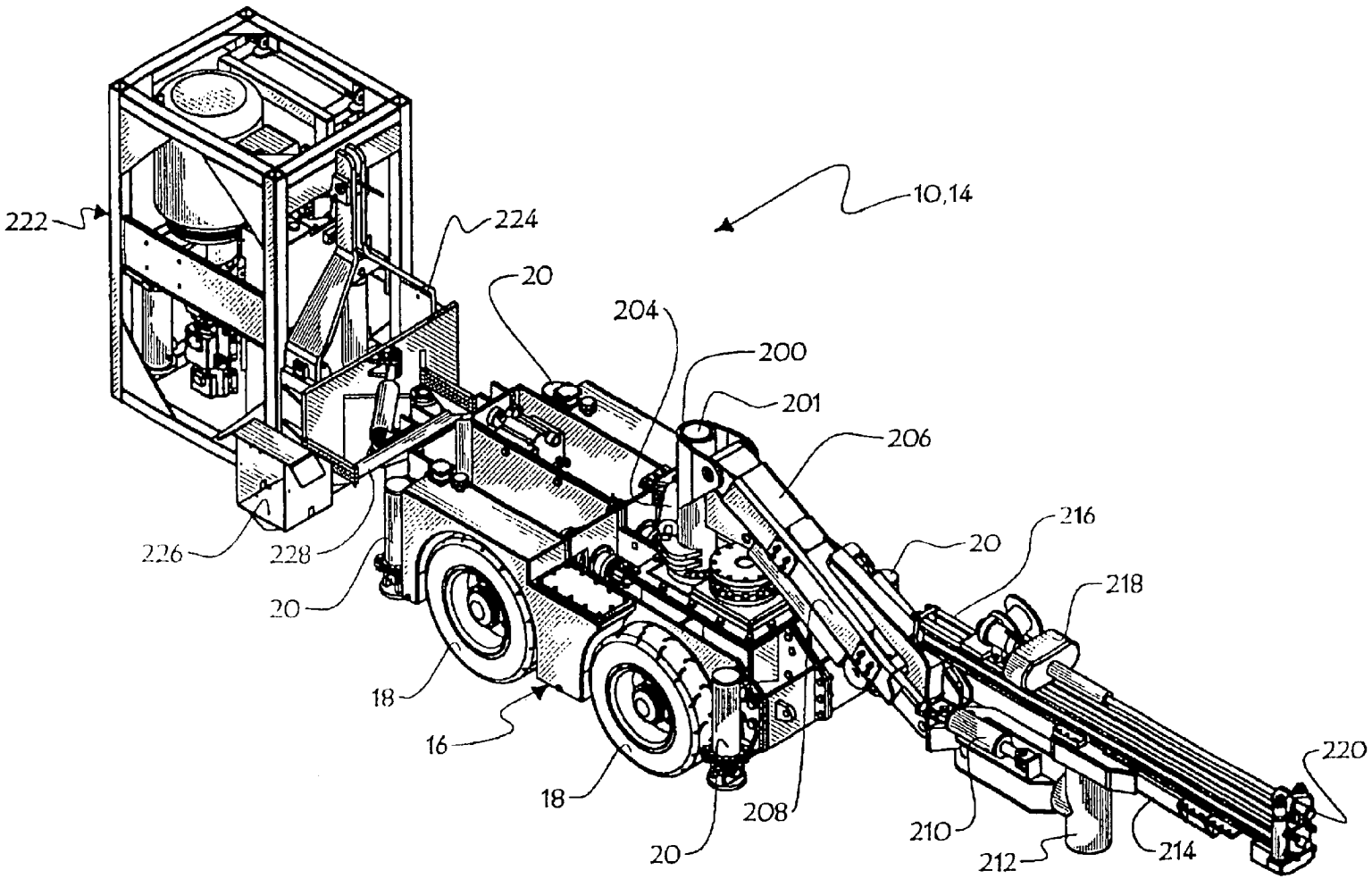
FIG. 7 is a front perspective view of a second assembly of the drilling vehicle according to the present invention.
Figure 8:
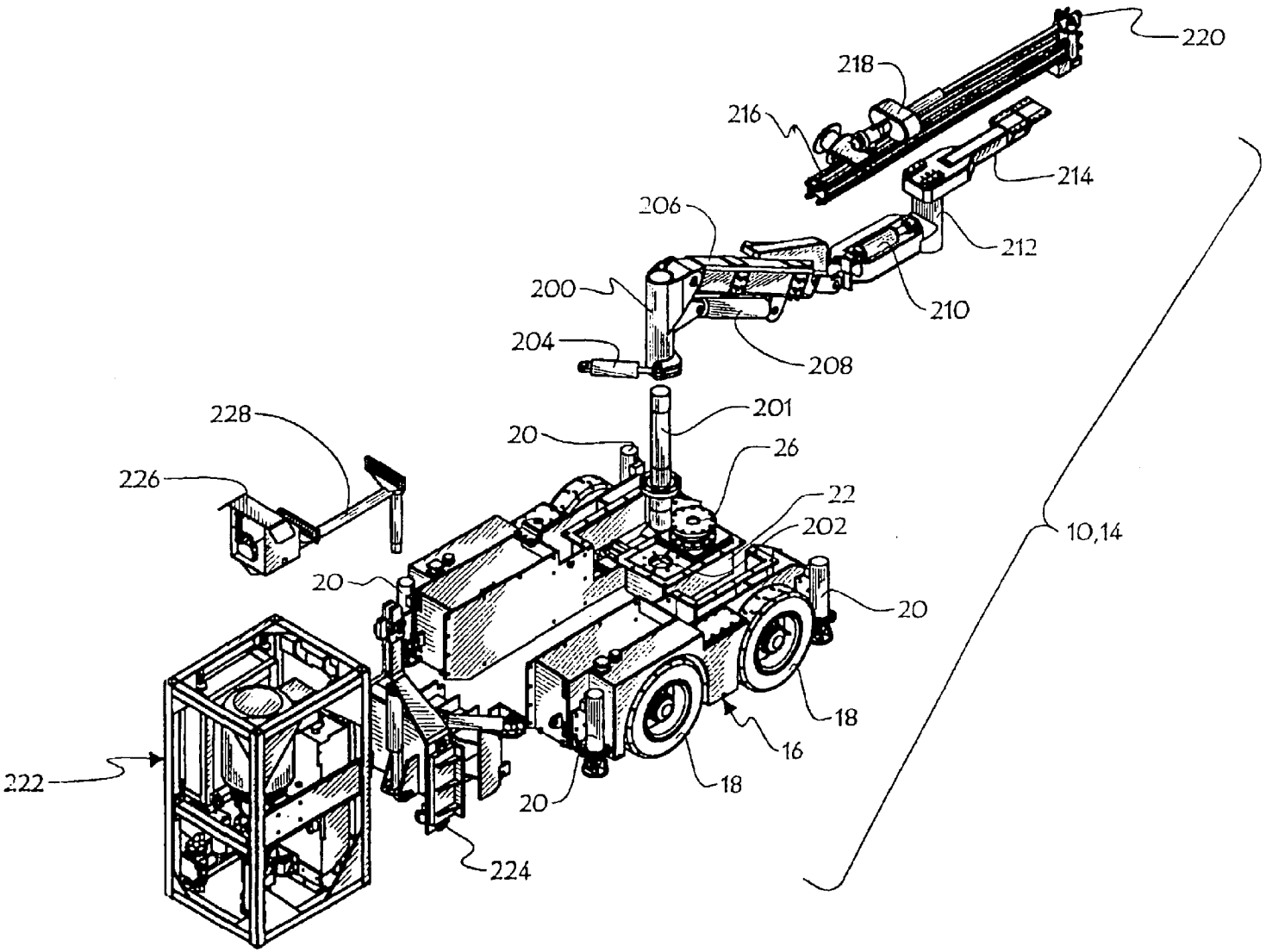
FIG. 8 is a rear exploded perspective view of the drilling vehicle of FIG. 7.

FIGS. 1 to 8 show the drilling vehicle 10 according to the present invention. Drilling vehicle 10 is equipped differently in FIGS. 1–5 and in FIGS. 7–8. Indeed, FIGS. 1–5 show a first assembly 12 of drilling vehicle 10 wherein vehicle 10 is equipped for production drilling, for cable installation drilling and for ascending or descending mine shaft formations; while FIGS. 7–8 show a second assembly 14 of drilling vehicle 10 wherein vehicle 10 is equipped for shaft development drilling. Each assembly 12, 14 differs in that the vehicle is equipped with different drilling tools and different actuator connection assemblies for operatively carrying the drilling tools on vehicle 10.

It can be seen from FIGS. 1–5 that the first assembly 12 of drilling vehicle 10 comprises a chassis 16 having two chassis portions 16*a*, 16*b* which are releasably attached together, e.g. with bolts. Although chassis 16 comprises only two chassis portions 16*a*, 16*b* in the annexed drawings, it is understood that it could include more than two portions without deviating from the scope of the present invention. The releasable chassis portions 16*a*, 16*b* may be disassembled to facilitate the transportation of vehicle 10 in the often narrow mine corridors.

Chassis 16 is movable over ground on four wheels 18 which are installed in aligned pairs on each chassis portion 16*a*, 16*b*. In one embodiment, each wheel 18 is mounted to chassis 16 by means of planet-type joints (not shown) instead of conventional axles. In one embodiment, each wheel 18 has a respective motor (not shown), which can be for example a hydraulic motor. Such independently powered wheels have the advantage of offering increased control over vehicle 10, for example if it is moved over uneven, soft or slick ground surfaces, and also if it is desired to turn vehicle while it is rolling, about a tight corner.

Chassis 16 is further provided with four selectively controlled retractable hydraulic legs 20, being positioned at the four corners of the generally rectangular chassis 16. Legs 20 can be commanded to extend downwardly or retract upwardly, to respectively engage the ground or clear the ground. Consequently, vehicle 10 can be selectively temporarily lifted until most or all of the load is carried by the extracted legs 20 instead of wheels 18, to securely immobilize vehicle 20 during drilling operations.

Figure 1:
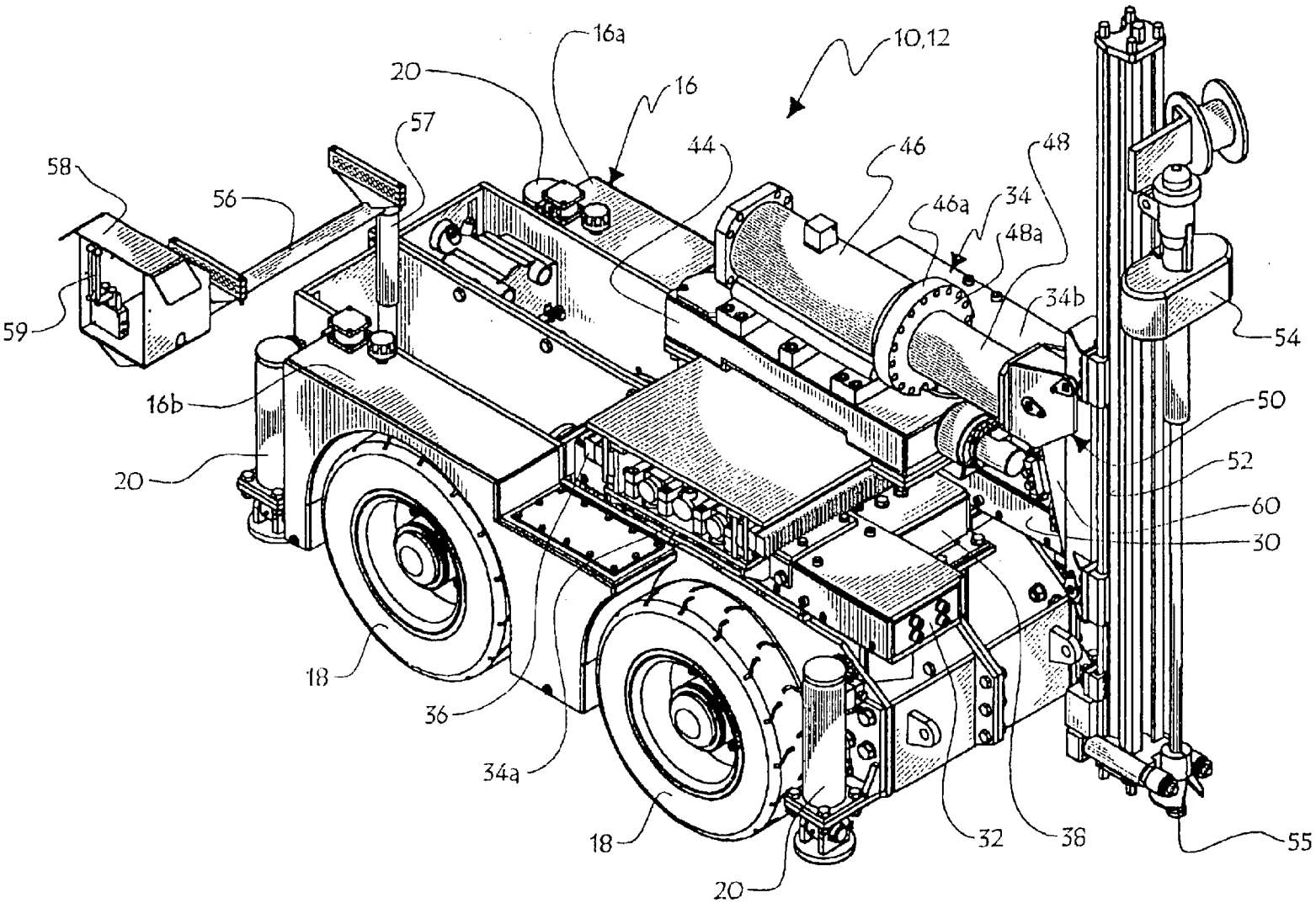
FIG. 1 is a front perspective view of a first assembly of the drilling vehicle according to the present invention, with the drilling arm in a downwardly oriented position.
Figure 2:
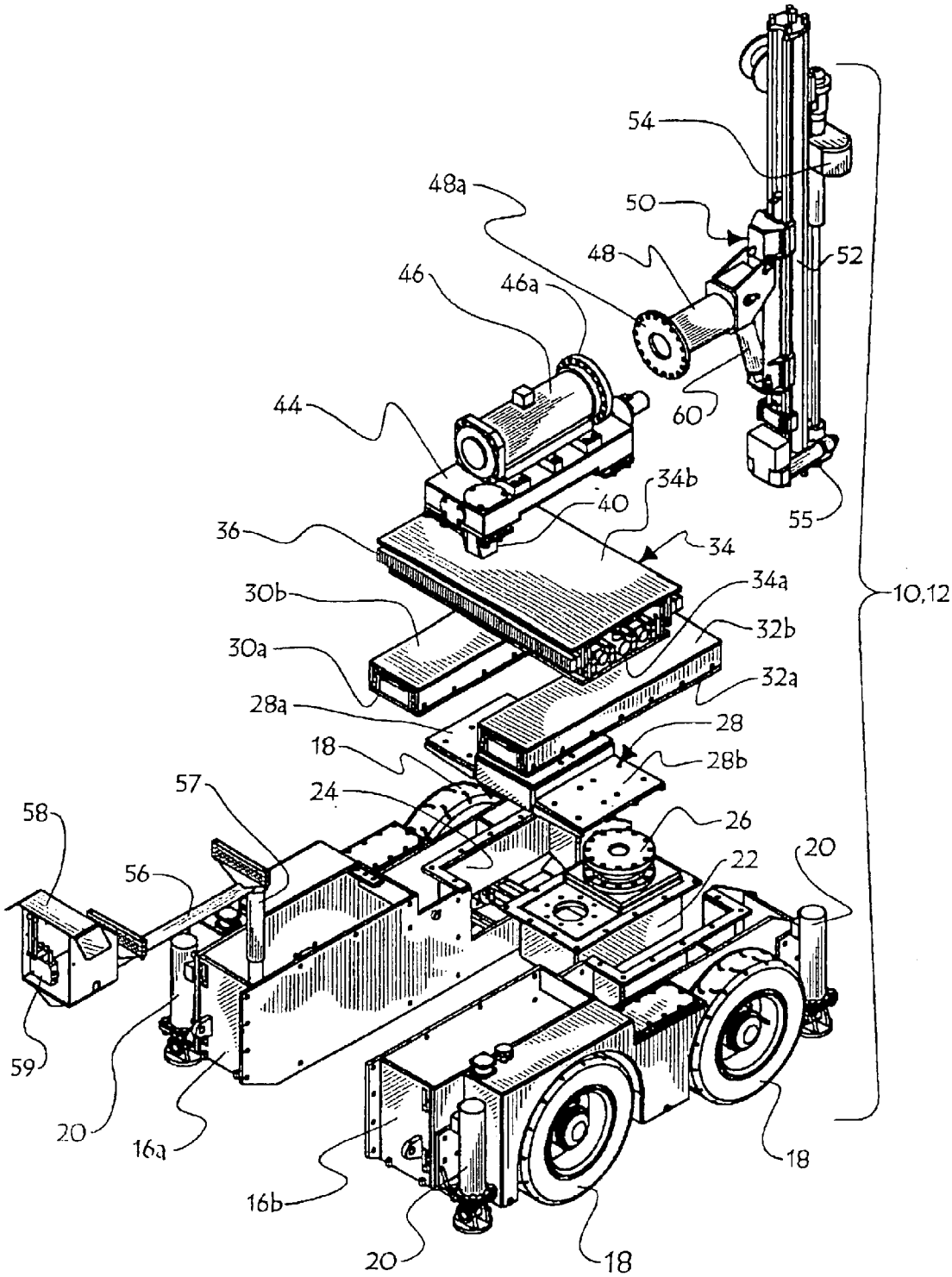
FIG. 2 is a rear exploded perspective view of the drilling vehicle of FIG. 1.
Figure 3:
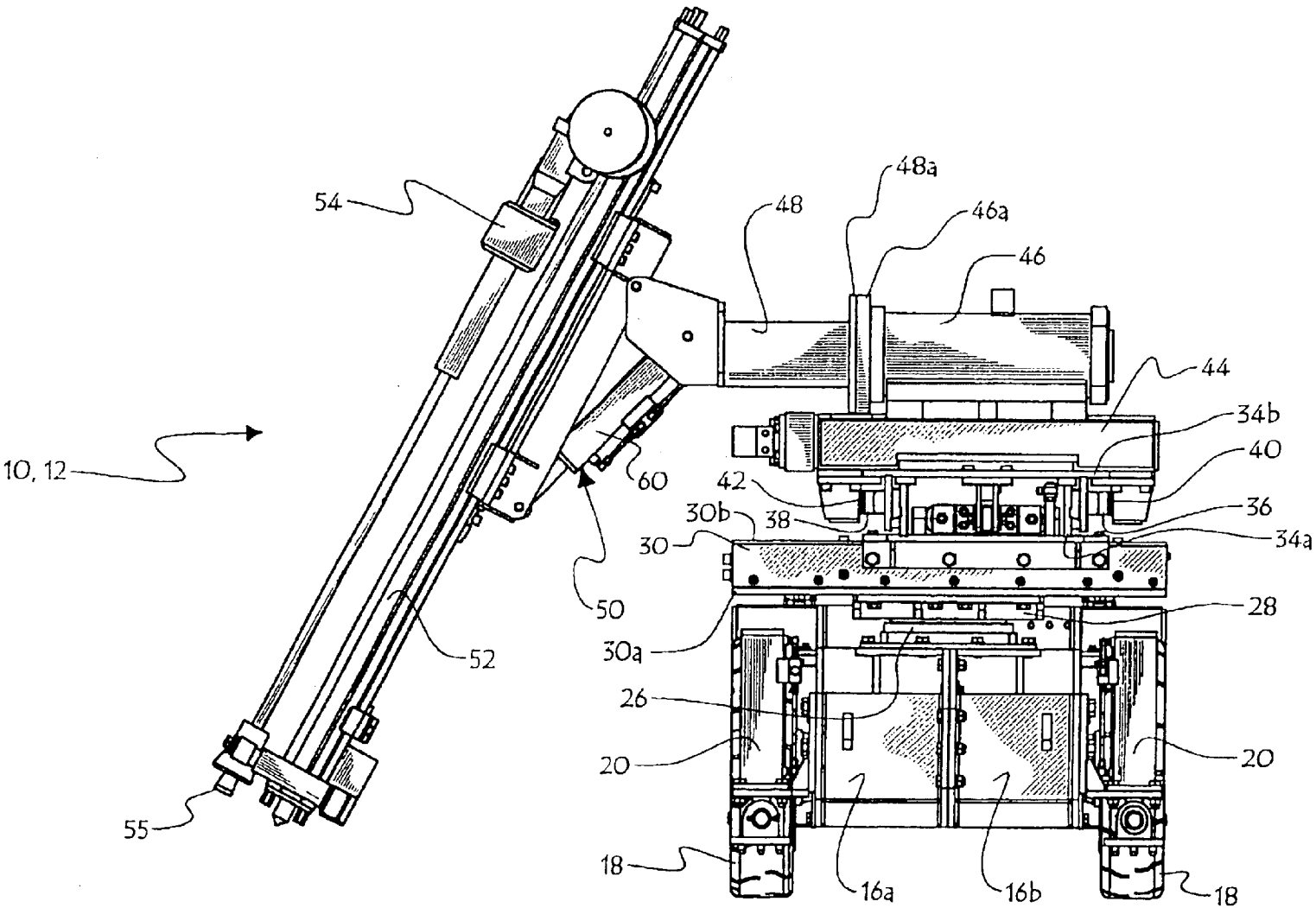
FIG. 3 is a rear elevation of the drilling vehicle of FIG. 1, with the drilling arm in a sidewardly inclined position.

Chassis 16 supports a tool frame 22 which is embedded into a complementarily formed opening 24 in chassis portions 16*a*, 16*b* (FIG. 2). Tool frame 22 carries a first actuator in the form of a vertical rotatable and selectively controlled platform shaft 26 which supports a platform 28. From a frontwardly oriented position such as in FIG. 2, platform 28 can rotate 90° to the right and 90° to the left relative to chassis 16 by means of platform shaft 26, for a total angular displacement capacity of 180°. FIG. 3 shows a 90° rotation of platform shaft 26 towards the left-hand side of vehicle 10, 12.

Platform 28 supports a second actuator in the form of a pair of first slider track members 30, 32. More particularly, platform 28 is formed with two side wings 28*a*, 28*b* which each support a corresponding elongated first slider track member 30, 32 each comprising lower runs 30*a*, 32*a* fixed to platform 28 and upper runs 30*b* and 32*b* which can longitudinally slide along lower runs 30*a* and 32*a* respectively. Upper runs 30*b*, 32*b* can move according to a linear translation between two limit positions in a back and forth movement relative to the lower runs 30*a*, 32*a*, with both upper runs 30*b*, 32*b* moving in an integral movement. The two limit positions of first slider track members 30, 32 are limited according to the length of the lower runs of first slider track members 30, 32. Indeed, upper runs 30*b*, 32*b* must remain attached to and supported by lower runs 30*a*, 32*a* during all upper run displacements.

A third actuator in the form of an elongated second slider track member 34 has a lower run 34*a* fixedly attached to the upper runs 30*b*, 32*b* of first slider track members 30, 32, and perpendicularly extending relative to first slider track members 30, 32. An upper run 34*b* of second slider track member 34 is longitudinally slidable along the lower run 34*a* in a back and forth movement between two limit positions. The two limit positions of second slider track member 34 are limited according to the length of lower run 34*a*. Indeed, upper run 34*b* must remain attached to and supported by lower run 34*a* during all upper run displacements.

The upper run 34*b* of second slider track member 34 is provided with a pair of longitudinal toothed racks 36, 38 positioned on opposite side edges of second slider track member 34 and which extend parallel to the axis of displacement of the upper run 34*b* of second slider track member 34. Toothed racks 36, 38 are respectively engaged by complementary toothed gear wheels 40, 42 that are selectively controlled and rotatably mounted on a movable support block 44 which is selectively longitudinally slidable along the elongated second slider track member 34 between two limit positions. Support block may be moved along the upper run 34*b* of track member 34 by means of the selectively powered rack and gear assembly 36, 38, 40, 42. The two limit positions of support block 44 are limited according to the length of racks 36, 38; i.e. support block 44 may be moved until wheels 40, 42 reach the extremities of racks 36, 38. Movable support block 44 together with rack and gear assembly 36, 38, 40, 42 form an auxiliary actuator.

Figure 4:
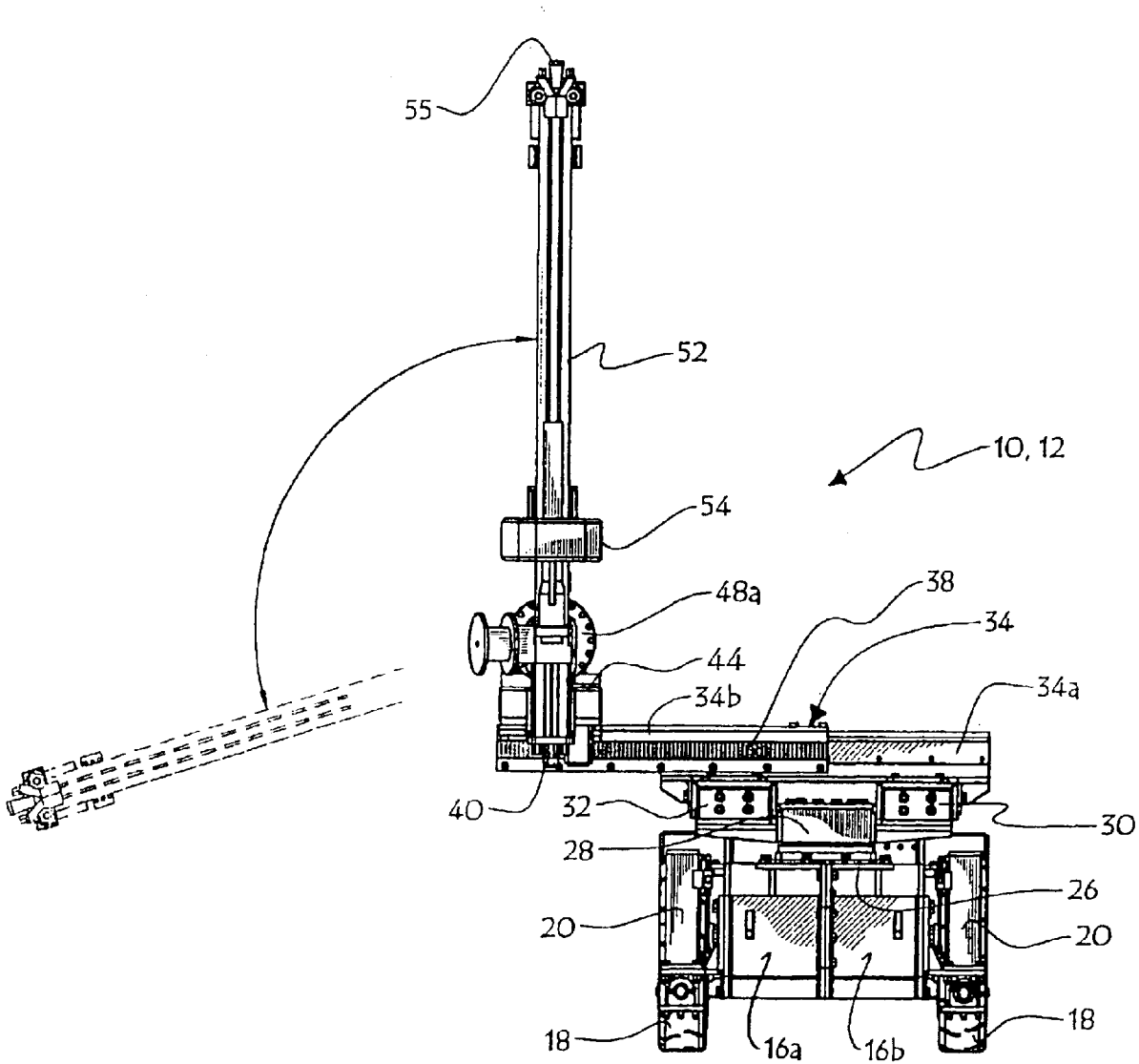
FIG. 4 is a front elevation of the drilling vehicle of FIG. 1, with the drilling arm in a raised upwardly oriented position, and further suggesting in phantom lines an alternate downwardly inclined position of the drilling arm.
Figure 5:
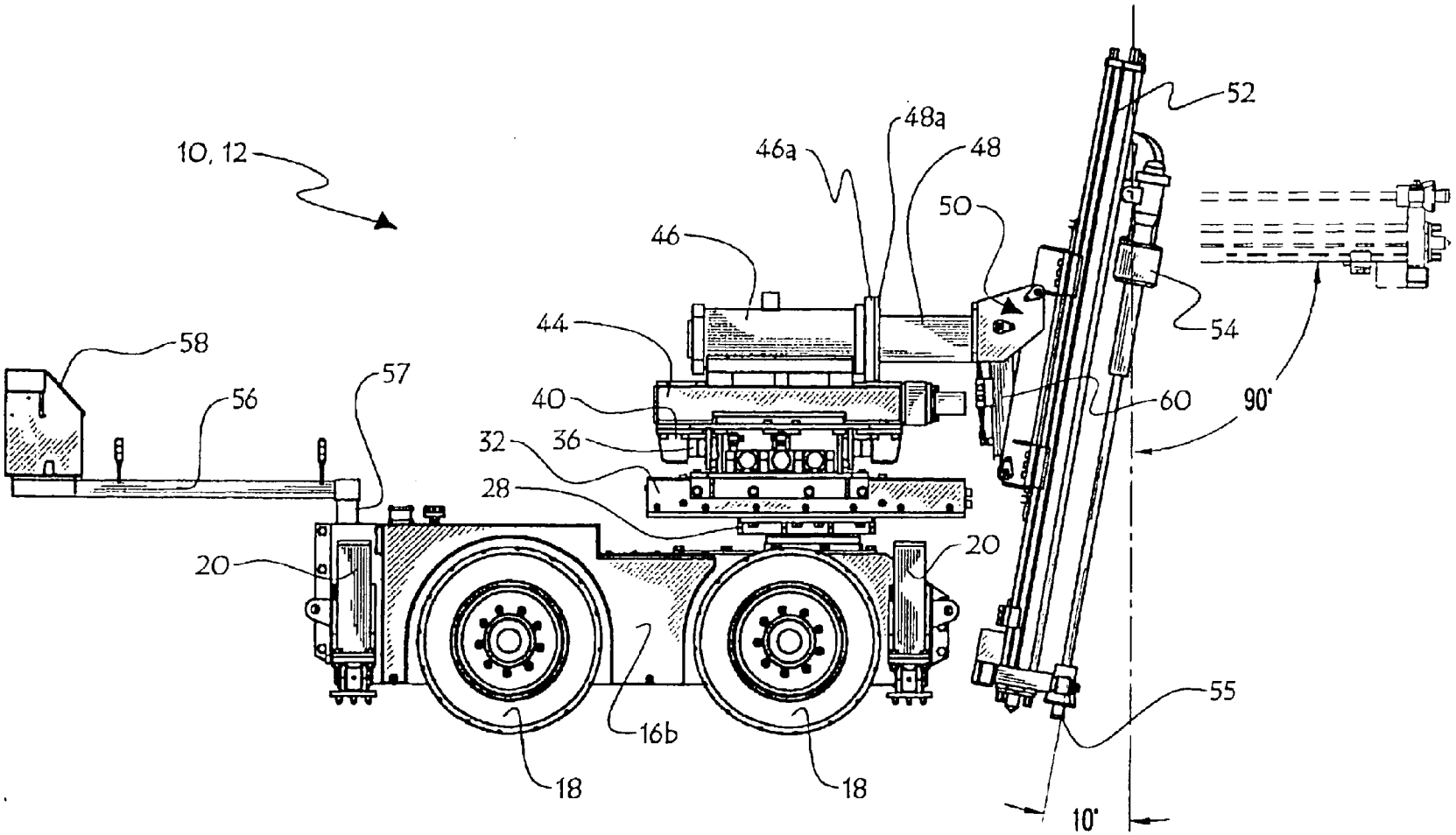
FIG. 5 is a side elevation of the drilling vehicle of FIG. 1, with the drilling arm in a downwardly inclined position, and further suggesting in phantom lines an alternate forwardly extending position of the drilling arm.

A fourth actuator comprises a hydraulic cylinder 46 of known construction that is fixedly attached to support block 44. Cylinder 46 includes a rotatable flange 46*a* which is carried by an inner rotatable cylinder rod (concealed in the drawings) that can be selectively hydraulically controlled for selected rotation thereof. A tool shaft 48 is equipped with a flange 48*a* bolted to the cylinder rotatable flange 46*a*, to allow integral rotation of shaft 48 and flange 46*a*. Tool shaft 48 has a rotational capacity of a full 360° angle under the control of cylinder 46. FIG. 4 suggests in phantom lines the rotation of tool arm 52 under the control of cylinder 46.

The end of tool shaft 48 opposite flange 48*a* carries a fifth actuator in the form of a selectively controlled pivotable linkage 50 including a hydraulic piston 60, which pivotably supports a tool arm 52. Tool arm 52 is provided with a selected tool, for example a hydraulically powered drilling tool 54 having a drilling extremity 55. Linkage 50 and piston 60 provide at least one quarter of a turn rotational capacity to tool arm 52 in one embodiment. In the embodiment illustrated in the annexed drawings, tool arm 52 may be pivoted from 0° to 100° with linkage 50, for example from a horizontal position as shown in phantom lines in FIG. 5 to a downwardly and inwardly inclined position as shown in full lines in FIG. 5.

An elbowed control arm 56 is mounted to chassis 16 at pivot 57 so as to allow rotational displacement of arm 56 all around a vertical axis. Control arm 56 carries at its outer free end a control console 58 which includes control mechanisms 59 used to control the movement of vehicle 10, and also the different displacements of tool 54 through the first, second third, fourth, fifth and auxiliary actuators. During use of vehicle 10, control arm 56 may be positioned at any selected angular position to facilitate the access to control mechanisms 59. This may be useful for example in narrow passages or in spaces encumbered with objects or rock formations which prevent easy access everywhere around vehicle 10, 12.

Known power means are used to power the different actuators of vehicle 10, 12. For example, in the case of conventional drilling vehicles, the power means is usually provided through a network of conduits running through the mine corridors, with the conduits being continuously provided with compressed air. These conduits can be plugged onto the drilling vehicle (plugs not shown), to pneumatically feed the vehicle actuators. In the annexed drawings, the different pneumatic and hydraulic conduits have been removed, to simplify the drawings, since a vehicle is normally encumbered with an important number of such conduits. In one embodiment, the actuators are hydraulically controlled, with the pneumatic power means being used to power the otherwise hydraulic actuators, as known in the art. That is to say, platform shaft 26 is hydraulically controlled in its rotational movement; the upper runs 30*b*, 32*b* of first slider track members 30, 32 are hydraulically controlled in their translation; the upper run 34*b* of second slider track member 34 is hydraulically controlled in its translation; rotational cylinder 46 is hydraulically controlled in its rotation; and tool arm 52 is controlled in its pivotal displacement by hydraulic piston 60.

The position and orientation of the drilling tool drilling extremity 55 can thus be controlled with the first, second, third, fourth and fifth actuators, and with the auxiliary actuator. Indeed, the first, second, third, fourth and fifth actuators, together with the auxiliary actuator, form a tool arm actuator assembly attaching tool arm 52 to chassis 16 that allows the following tool arm displacements (actuators allowing these displacements in parentheses):

a) rotational displacement of tool arm 52 about a vertical axis of an angle of 0° to 180° relative to a reference position (first actuator);

b) a linear translation of tool arm 52 along a first horizontal axis (second actuator);

c) a linear translation of tool arm 52 along a second horizontal axis which is perpendicular to the first horizontal axis (third actuator);

d) a rotational displacement of tool arm 52 about a third horizontal axis of an angle of 0° to 360° relative to a reference position (fourth actuator); and e) a pivotal displacement of said tool arm about a fourth horizontal axis which is perpendicular to said third horizontal axis of an angle of 0° to 100° relative to a reference position (fifth actuator).

The above-mentioned reference positions are limit positions of the tool arm, from which the full rotational or pivotal capacity of each actuator may be evaluated.

In one embodiment, the above-mentioned first and third horizontal axes are parallel, as shown in the drawings.

The auxiliary actuator formed of the support block 44 movable through rack and gear assembly 36, 38, 40, 42 allows a linear translation of tool arm 52 along the above-mentioned second horizontal axis. This displacement of tool arm 52 is independent of the translation resulting from the third actuator formed of second slider track member 34, even though they are aligned along the second horizontal axis. This dual aligned movement is useful since it allows tool arm 52 to be moved transversely of first slider track members 30, 32 without the upper run 34*b* of second slider track member 34 protruding in an obtrusive manner, which would otherwise occur if upper run 34*b* were to be extracted sidewardly. Indeed, as shown in FIG. 4, support block 44 can move to one side edge of the second slider track member upper run 34*b* while the latter is not in a fully extracted sideward position, for example to locate the tool arm 52 adjacent an exterior structure in a vertical position as shown in full lines, such as adjacent a vertical wall, without the second slider track member upper run 34*b* obstructing this tool arm positioning.

It is envisioned, according to an alternate embodiment, that the third actuator be used exclusively of the auxiliary actuator, or vice-versa, since both the third and auxiliary actuator allow parallel linear translations of the tool arm. In the present application, it is understood that if the above-defined third actuator is not included on a drilling vehicle, then the so-called auxiliary actuator would be named third actuator, since it would not be auxiliary to any other actuator, being the only actuator allowing linear translation of the tool arm according to the second horizontal axis.

FIG. 6 shows a tool arm 100 according to one embodiment of the invention. Tool arm 100 can be used instead of tool arm 52.

Tool arm 100 comprises an elongated track 102 having a cross-sectionally concave central longitudinal channel 104 formed therein. Side rails 106, 108 are fixed to each longitudinal side of track 102. An endless screw 110 is rotatably mounted to track 102 at one protruding end 111 thereof, and is engaged by a selectively powered drilling tool 112 which may be displaced longitudinally along track 102 by means of endless screw 110. More particularly, tool 112 is fixed to a carriage 114 which slidingly engages track 102 and rails 106 so as to prevent any accidental disengagement of tool 112 from tool arm 100 during use. Thus, tool 112 is only allowed controlled longitudinal displacement along tool arm 100. Carriage 114 is formed of a metallic alloy including pure carbon for enhanced hardness of the carriage, which is desirable since it will increase the life span of carriage 114 which is subjected to wear due to frequent sliding displacements. According to one embodiment, carriage 114 may have a 43 hardness factor according to the Rockwell scale. Upon carriage 114 becoming worn, it can be removed and replaced without the whole drilling tool having to be replaced. Tool 112 comprises a drilling extremity 116.

FIGS. 7 and 8 show the second assembly 14 of drilling vehicle 10 wherein vehicle 10 is equipped for shaft development drilling. In this embodiment, vehicle 10 has a number of elements which are identical to the first vehicle assembly 10, 12; however, the tool, tool actuators and power supply are different in this second vehicle assembly 10, 14.

Vehicle 10, 14 comprises modular chassis 16 movable over ground on four wheels 18, with the four immobilizing legs 20 also being provided. These elements are the same as the ones shown in the first embodiment. However, platform 28 and all elements located thereover have been removed, to install on vehicle 10, 14 a different tool arm actuator assembly.

Vehicle 10, 14 comprises a first actuator in the form of a selectively powered central sleeve 200 rotatably engaging a post 201 fixedly mounted to tool frame 22 in an aperture 202 made behind platform shaft 26. A hydraulic piston 204, fixed at its base to chassis 16, engages central sleeve 200 for rotating sleeve 200. In one embodiment, sleeve 200 can be rotated by up to 15° to the right and by up to 15° to the left, for a total 30° angle rotational capacity.

Vehicle 10, 14 comprises a second actuator in the form of an arm 206 carried by sleeve 200 and selectively controlled by a hydraulic piston 208 attached between sleeve 200 and arm 206. Arm 206 is pivotally mounted to sleeve 200 at its first end and pivotally linked to a third actuator in the form of a horizontal rotational hydraulic cylinder 210, the latter having a 360° rotation capacity about a horizontal axis which is perpendicular to the pivotal axes linking arm 206 to sleeve 200 and to horizontal rotational cylinder 210 respectively. Horizontal rotational cylinder 210 carries at its extremity opposite arm 206 a fourth actuator in the form of a vertical rotational cylinder 212 having a 360° rotation capacity about a vertical axis. A tool arm carrying plate 214 is fixedly attached on top of vertical rotational cylinder 212, with a tool arm 216 equipped with a drilling tool 218 being releasably attached to carrying plate 214. Tool 218 has a drilling extremity 220.

The actuator assembly comprising the first, second, third and fourth actuators of vehicle 10, 14 is equipped in one embodiment with an automated parallelism system which allows tool arm 216 to remain frontwardly oriented relative to chassis 16 and horizontal at all times. This is accomplished by interconnecting and calibrating the different first, second, third and fourth actuators of vehicle 10, 14 so that any displacement of tool arm 216 will result in tool arm 216 remaining horizontal and frontwardly oriented. It may still be rotated about a horizontal axis extending longitudinally of chassis 16 by means of horizontal rotation cylinder 210. This feature of actuator assembly 200, 201, 204, 206, 208, 210, 212, 214 is useful for development drilling.

Vehicle 10, 14 is also equipped with a power pack 222 releasably attached to the rear end of chassis 16 by means of a power pack support rack 224. Power pack 222 comprises an electric motor and a pneumatic pump for pneumatically feeding vehicle 10, 14 where no mine pneumatic network is readily available. Such a power pack 222 could also be installed on the first assembly of vehicle 10, 12.

A control console 226 is also provided on vehicle 10, 14 by means of a pivotable arm 228 for controlling the different first, second, third and fourth actuators for in turn controlling the position and orientation of the drilling tool drilling extremity 220.

According to the present invention, the drilling vehicle 10 thus forms a kit which can be used with either one of the two actuator assemblies to form vehicle 10, 12 or vehicle 10, 14. The drilling vehicle kit comprises:

- a modular chassis 16 movable over ground;
- a tool arm 52 or 100 or 216;
- at least one drilling tool 54 or 112 or 218 operatively attachable to the tool arm and defining a drilling extremity 55 or 116 or 220;
- a first tool arm actuator assembly according to the first assembly of the vehicle 10, 12, with the tool arm being releasably attachable to said chassis through the instrumentality of the first tool arm actuator assembly of vehicle 10, 12 which allows the tool arm to be moved according to a first set of directions when the tool arm is operatively mounted to the chassis by means of the first tool arm actuator assembly;
- a second tool arm actuator assembly according to the second assembly of the vehicle 10, 14, with the tool arm being releasably attachable to the chassis through the instrumentality of the second tool arm actuator assembly of vehicle 10, 12 which allows the tool arm to be moved according to a second set of directions when the tool arm is operatively mounted to the chassis by means of the second tool arm actuator assembly; and
- selectively controlled power means controlling the first and second tool arm actuator assemblies; wherein either one of the first and second tool arm actuator assemblies may be used to attach the tool arm to the chassis, according to a selected set of directions among the first and second sets of directions, and wherein the position and orientation of the at least one drilling tool drilling extremity is controlled according to the selected set of directions.

Example of drilling tools which can be used on the drilling vehicle 10 are as follows:

for production, cable installation or mine raise drilling: Secan S36 by Boart (pneumatic); PR55 by Gardner Denver (pneumatic); HC80 by Montabert (hydraulic); ol 238 by Atlas Copco (hydraulic);

for development drilling: L600 or E600 by Tamrock (pneumatic); Secan S361R by Boart (pneumatic); HL500 by Tamrock (hydraulic); HC50 by Montabert.

It is understood that throughout the present specification, vertical and horizontal axes relate to the present drilling vehicle standing over horizontal ground level.

I claim:

1. A drilling vehicle comprising:

a chassis movable over ground;

a tool arm;

a drilling tool operatively mounted to said tool arm and defining a drilling extremity;

a tool arm actuator assembly attaching said tool arm to said chassis and comprising:

a first tool arm actuator allowing rotational displacement of said tool arm about a first axis;

a second tool arm actuator allowing translational displacement of said tool arm along a second axis between two limit positions;

a third tool arm actuator allowing translational displacement of said tool arm along a third axis between two limit positions;

a fourth tool arm actuator allowing rotational displacement of said tool arm about a fourth axis; and a fifth tool arm actuator allowing pivotal displacement of said tool arm about a fifth axis; and selectively controlled power means controlling said first, second, third, fourth and fifth tool arm actuators;

wherein the position and orientation of said drilling tool drilling extremity is controlled with said first, second, third, fourth and fifth tool arm actuators acting on said tool arm.

2. A drilling vehicle as defined in claim 1, wherein said second axis is transversal to said first axis and said third axis is transversal to said second axis.

3. A drilling vehicle as defined in claim 2, wherein first axis is vertical, said second, third and fourth axes are horizontal, said second axis is perpendicular to said first axis, said third axis is perpendicular to said second axis and said fifth axis is perpendicular to said fourth axis.

4. A drilling vehicle comprising:

a chassis movable over ground;

a tool arm;

a drilling tool operatively mounted to said tool arm and defining a drilling extremity;

a tool arm actuator assembly attaching said tool arm to said chassis and comprising:

a first tool arm actuator allowing rotational displacement of said tool arm about a vertical axis;

a second tool arm actuator allowing linear translation of said tool arm along a first horizontal axis between two limit positions;

a third tool arm actuator allowing linear translation of said tool arm along a second horizontal axis which is perpendicular to said first horizontal axis, between two limit positions;

a fourth tool arm actuator allowing rotational displacement of said tool arm about a third horizontal axis; and a fifth tool arm actuator allowing pivotal displacement of said tool arm about a pivotal axis which is perpendicular to said third horizontal axis; and selectively controlled power means controlling said first, second, third, fourth and fifth tool arm actuators;

wherein the position and orientation of said drilling tool drilling extremity is controlled with said first, second, third, fourth and fifth tool arm actuators acting on said tool arm.

5. A drilling vehicle as defined in claim 4, wherein said chassis is modular and comprises at least two chassis portions releasably attached to one another, said tool arm being releasably attached to said tool arm actuator assembly and said tool arm actuator assembly being releasably attached to said chassis.

6. A drilling vehicle as defined in claim 4, wherein said first tool arm actuator allows said tool to rotate from 0° to 180° relative to a reference position.

7. A drilling vehicle as defined in claim 4, wherein said first and third horizontal axes are parallel to each other.

8. A drilling vehicle as defined in claim 4, wherein said fourth tool arm actuator allows said tool arm to rotate from 0° to 360° relative to a reference position.

9. A drilling vehicle as defined in claim 4, wherein said fifth tool arm actuator allows said tool arm to pivot of at least one quarter of a turn relative to a reference position.

10. A drilling vehicle as defined in claim 9, wherein said fifth tool arm actuator allows said tool arm to pivot of an angle of 0° to 100° relative to a reference position.

11. A drilling vehicle as defined in claim 4, wherein said tool arm actuator assembly further comprises an auxiliary tool arm actuator allowing linear translation of said tool arm along said second horizontal axis between two limit positions, independently of said translation of said tool arm resulting from said third tool arm actuator.

12. A drilling vehicle as defined in claim 11, wherein said first, second, third, auxiliary, fourth and fifth tool arm actuators are sequentially attached to one another and wherein said auxiliary tool arm actuator comprises a support block movably mounted to said third tool arm actuator by means of a rack and gear assembly, so as to allow said linear translation of said tool arm along said second horizontal axis between two limit positions, independently of said translation of said tool arm resulting from said third tool arm actuator.

13. A drilling vehicle as defined in claim 4, wherein said first, second, third, fourth and fifth tool arm actuators are sequentially attached to one another and wherein said first tool arm actuator comprises a platform shaft mounted to said chassis so as to be rotatable about said vertical axis.

14. A drilling vehicle as defined in claim 4, wherein said first, second, third, fourth and fifth tool arm actuators are sequentially attached to one another and wherein said second tool arm actuator comprises a platform integrally attached to said first tool arm actuator and a slider track member having a lower run fixedly attached to said platform and an upper run movably carried by said lower run for allowing translation of said upper run along said first horizontal axis between two limit positions.

15. A drilling vehicle as defined in claim 14, wherein said second tool arm actuator comprises another slider track member having a lower run fixedly attached to said platform and an upper run movably carried by said lower run for allowing translation of said upper run parallel to said first horizontal axis between two limit positions, said upper run of said another first slider track member being integrally movable with said upper run of the first-mentioned said first slider track member.

16. A drilling vehicle as defined 1, wherein said first, second, third, fourth and fifth tool arm actuators are sequentially attached to one another and wherein said third tool arm actuator comprises a slider track member having a lower run fixedly attached to said second tool arm actuator and an upper run movably carried by said lower run for allowing translation of said upper run along said first horizontal axis between two limit positions.

17. A drilling vehicle as defined in claim 4, wherein said first, second, third, fourth and fifth tool arm actuators are sequentially attached to one another and wherein said fourth tool arm actuator comprises a tool shaft rotatably carried by said third tool arm actuator and rotatable about said third horizontal axis.

18. A drilling vehicle as defined in claim 4, wherein said first, second, third, fourth and fifth tool arm actuators are sequentially attached to one another and wherein said fifth tool arm actuator comprises a pivotable linkage pivotally mounted to said fourth tool arm actuator and carrying a hydraulic cylinder, said linkage and said cylinder also being attached to said tool arm, allowing pivotal displacement of said tool arm about said pivotal axis.

19. A drilling vehicle as defined in claim 4, further comprising a control console linked to said selectively controlled power means and controlling said first, second, third fourth and fifth tool arm actuator, said control console being carried by a control arm pivotally mounted to said chassis.

* * * * *